US005320562A

United States Patent [19]

Möller et al.

[11] Patent Number: 5,320,562

[45] Date of Patent: Jun. 14, 1994

[54] CAPPED ELECTRIC LAMP

[75] Inventors: Johannes Möller, Aachen; Reiner Feder, Simmerath, both of Fed. Rep. of Germany; Willem G. De Vrij, Eindhoven, Netherlands

[73] Assignee: U.S. Philips Corporation, New York, N.Y.

[21] Appl. No.: 966,203

[22] Filed: Oct. 26, 1992

[30] Foreign Application Priority Data

Jul. 1, 1992 [EP] European Pat. Off. ..... 92201953.4

[51] Int. Cl.[5] ..... H01R 17/00

[52] U.S. Cl. ..... 439/613; 439/869

[58] Field of Search ..... 439/612, 613, 616, 617, 439/611, 874, 869, 870–873

[56] References Cited

U.S. PATENT DOCUMENTS

| | | | |
|---|---|---|---|
| 2,300,870 | 11/1942 | Carlson | 439/616 |
| 2,465,414 | 3/1949 | Abshire | 439/612 |
| 2,758,268 | 8/1956 | Peyssou | 439/874 |
| 5,080,610 | 1/1992 | Kanaya et al. | 439/612 |
| 5,177,397 | 1/1993 | Nagasawa et al. | 439/612 |

*Primary Examiner*—Larry I. Schwartz

*Assistant Examiner*—Hien D. Vu

*Attorney, Agent, or Firm*—Paul R. Miller

[57] ABSTRACT

A cap electric lamp of the type used in optical systems, for example, or as a vehicle headlamp, includes a glass lamp vessel with a first and a second neck-shaped portion in mutually opposing arrangement with seals through which current supply conductors extend to an electric element arranged in the lamp vessel. A metal sleeve is provided having a longitudinal slot around the first neck-shaped portion holding the lamp vessel with a clamping fit. This sleeve has a welding zone and a first and second clamping zone, each of which has a loop in the shape of an open hair pin. The clamping zones have respective, mutually opposing welding lugs which are interconnected by a welded joint so as to close the sleeve. A metal fixing member is provided with tongues which are welded to the sleeve in a welding zone of the sleeve. A lamp cap of insulating material is connected to the lamp vessel in which the fixing member is fixed and which has contact members to which the current supply conductors are connected. The welding zone is provided with mutually opposing closing tags alongside the longitudinal slot.

10 Claims, 2 Drawing Sheets

CAPPED ELECTRIC LAMP

The invention relates to a capped electric lamp comprising:

a glass lamp vessel with, in mutually opposing arrangement, a first and a second neck-shaped portion with seals through which respective current supply conductors extend to an electric element arranged in the lamp vessel;

a metal sleeve having a longitudinal slot around the first neck-shaped portion of the lamp vessel, holding the lamp vessel with clamping fit, which sleeve has a welding zone and a first and a second clamping zone each with a loop in the shape of an open hairpin, which clamping zones have respective, mutually opposing welding lugs which are interconnected by means of a welded joint so as to close the sleeve;

a metal fixation member provided with tongues which are welded to the sleeve in the latter's welding zone;

a lamp cap of insulating material connected to the lamp vessel, in which lamp cap the fixation member is fixed and which has contact members to which the current supply conductors are connected.

BACKGROUND OF THE INVENTION

Such a lamp, in which the electric element is a pair of electrodes, is known from European Patent Application EP 0 478 058 A1corresponding to U.S. Pat. No. 5,216,319.

The lamp is designed to be used as a light source in optical systems, for example as a vehicle headlamp.

The sleeve and the fixation member are necessary for fixing the lamp vessel to the lamp cap in a position in which the electric element, or in the case of a pair of electrodes the discharge arc between them, is aligned relative to reference locations on the lamp cap. As a result, the electric element is given a predetermined position when the lamp is placed in an optical system. The lamp vessel may be shifted, tilted, and rotated during alignment, as necessary.

It is of major importance for the sleeve to hold on to the lamp vessel securely and nevertheless to cause no damage to the glass. It should be prevented that the sleeve loses its grip in the case of a temperature rise, during lamp operation, owing to a comparatively great thermal expansion, while on the other hand it should be prevented that the sleeve clamps too strongly at normal temperatures, when the lamp is extinguished, and generates undesirable strain in the glass.

It was found that the known sleeve involves the risk of causing damage to the glass it clamps when it is closed through making of welded joints during mechanized manufacture. Premature lamp failure can occur as a result of this. It was also found to be difficult to provide the known sleeve in mechanized manufacture.

SUMMARY OF THE INVENTION

It is an object of the invention to provide an electric lamp of the kind mentioned in the opening paragraph in which the risk of premature failure is counteracted and the sleeve is of a design which can be readily assembled with the lamp vessel.

According to the invention, this object is achieved in that the welding zone has mutually opposing closing tags alongside the slot.

With the sleeve of the known lamp, the electrodes, used for making the welded joints between the mutually opposing welding lugs, must exert on the welding lugs a force which is necessary for bringing the latter against one another before the welded joint can be made. The welding electrodes must exert a force during this which is different from the ideal mechanical force during welding. In addition, the electrodes may perform uncontrolled lateral movements during this, whereby the sleeve is also moved and damage to the glass may ensue.

In the sleeve of the lamp according to the invention, the closing tags form a provision which is separate from the welding lugs and on which tools can bear so as to pull them toward one another and thus press the welding lugs against one another. The closing tags, however, may also be used for opening the sleeve further while it is being provided. For this purpose, the closing tags are preferably so positioned as to be spaced apart from one another in the finished lamp, and accordingly also during and after fixing of the sleeve. It is ensured thereby to a greater extent that the welding lugs can actually be brought against one another. It is alternatively possible, however, for the closing tags to have the same interspacing as the welding lugs. The loop in the shape of an open hairpin then provides the tolerance necessary in view of dimensional variations of the clamped-in glass. The tools keep the sleeve stationary, so that welding electrodes cannot cause a movement of the sleeve.

It is in addition favourable that the closing tags render it possible to close the sleeve in a contactless manner, for example by means of laser welding, because the welding lugs are already pressed against one another by the force applied to the closing tags.

In a favourable embodiment of the lamp, the welding zone lies clear of the clamped-in glass. This has the advantage that strong local heating of the glass is avoided during making of the welded joints with the tongues of the fixation member. Such heating may give rise to undesirable strain in the glass, depending on the degree of heat generation.

A very wide tolerance as to the circumference of the clamped-in glass is offered by an embodiment of the sleeve in which each clamping zone comprises a second loop in the shape of an open hairpin. It is very favourable if the loops are positioned symmetrically relative to the longitudinal slot, for example, in a geometry in which the loops each enclose an angle of $90° \pm 10°$ with the welding lugs. It was found that additional loops do not lead to a substantial further widening of the tolerances.

The two loops in the geometry described have the advantage that the sleeve can be provided with a comparatively great pre-tension, i.e. that the sleeve already surrounds the glass with clamping fit when it has been provided, but has not yet been closed.

An attractive aspect of the sleeve is that it can be readily provided, also when pre-tension is present, in that the sleeve can be opened by forcing apart of the closing tags. In an embodiment, however, the sleeve has guiding tags which are directed towards the electric element and whose interspacing increases in a direction away from the sleeve, which guiding tags guide the glass to be clamped into the sleeve, acting as a funnel, when the sleeve is being provided.

The electric element may be a pair of electrodes in an ionizable gas, but alternatively may be an incandescent body, for example, in an inert gas comprising halogen.

The lamp vessel usually comprises glass with an $SiO_2$ content of at least 95% by weight, such as quartz glass, or alternatively hard glass.

An outer envelope may surround the lamp vessel. This envelope may be coupled to the first neck-shaped portion, for example, by means of a narrowed portion in the former. In that case the sleeve may also bear directly on the first neck-shaped portion, but it is alternatively possible for the sleeve to bear on the outer envelope while surrounding the first neck-shaped portion. In that case, the sleeve holds the lamp vessel with clamping fit in that the outer envelope is coupled to the lamp vessel.

The sleeve may be readily made from plate material, for example, stainless steel, for example, spring steel.

The contact members at the lamp cap may be formed as, for example, pins, strips, bushes, etc., or a combination thereof, so as to cooperate with a connector which is connected to a supply source. It is alternatively possible, however, that an insulated cable is fastened to each of the contact members with electric conduction, issuing to the exterior from a cover fastened to the lamp cap. Detachable electrical connections may thus be displaced towards the supply source.

The lamp cap may consist of, for example, a synthetic resin, for example, a thermoplastic synthetic resin such as polyether imide, polyether sulphon, polyphenylene sulphide, polyether etherketone, polypropylene oxide, polyamide imide, polyimide, polybutylene terephthalate, which may be charged with powdery or fibrous substances such as, for example, glass, chalk. The lamp cap may be integrated with or form part of a reflector for the light generated by the lamp.

Obviously, it is immaterial to the essence of the invention that variants are possible as to the electric element and the kind of lamp vessel and lamp cap of the lamp according to the invention, and as to the presence or absence of an outer envelope.

BRIEF DESCRIPTION OF THE DRAWINGS

An embodiment of the capped electric lamp according to the invention is shown in the drawings, in which

FIG. 5*a* is taken on the line Va in FIG. 3.

DESCRIPTURE OF THE INVENTION

Figure 1:
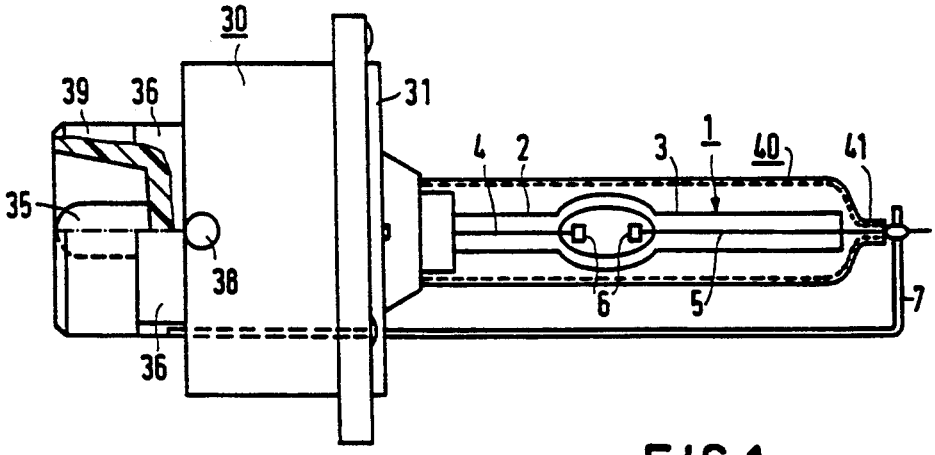
FIG. 1 shows an embodiment of the invention in side elevation.
Figure 2:
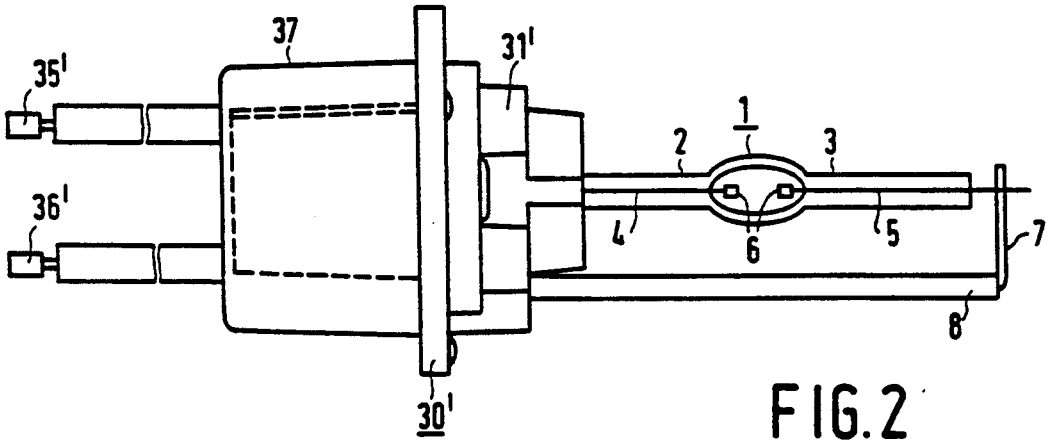
FIG. 2 shows a variation of FIG. 1 having a different cap and lacking an outer envelope.

In FIGS. 1 and 2, the capped electric lamp has a glass lamp vessel 1 with, in mutually opposing arrangement, a first 2 and a second 3 neck-shaped portion with seals through which respective current supply conductors 4, 5 extend to an electric element 6 arranged in the lamp vessel. The element in the Figures is a pair of electrodes in an ionizable gas.

A metal sleeve 10 (see FIGS. 4 and 5) with a longitudinal slot 11 is present around the first neck-shaped portion 2 of the lamp vessel 1, holding the lamp vessel with clamping fit. The sleeve (see FIG. 5) has a welding zone 12 and a first 13 and a second 14 clamping zone, each with an open hairpin loop 15. The clamping zones 13, 14 each have a welding lug 16 alongside the slot 11, which lugs oppose one another and are interconnected by means of a welded joint so as to close the sleeve 10.

A metal fixation member 20 (FIG. 4) is provided with tongues 21 which are welded to the clamping member 10 in the welding zone 12 thereof.

Figure 4:
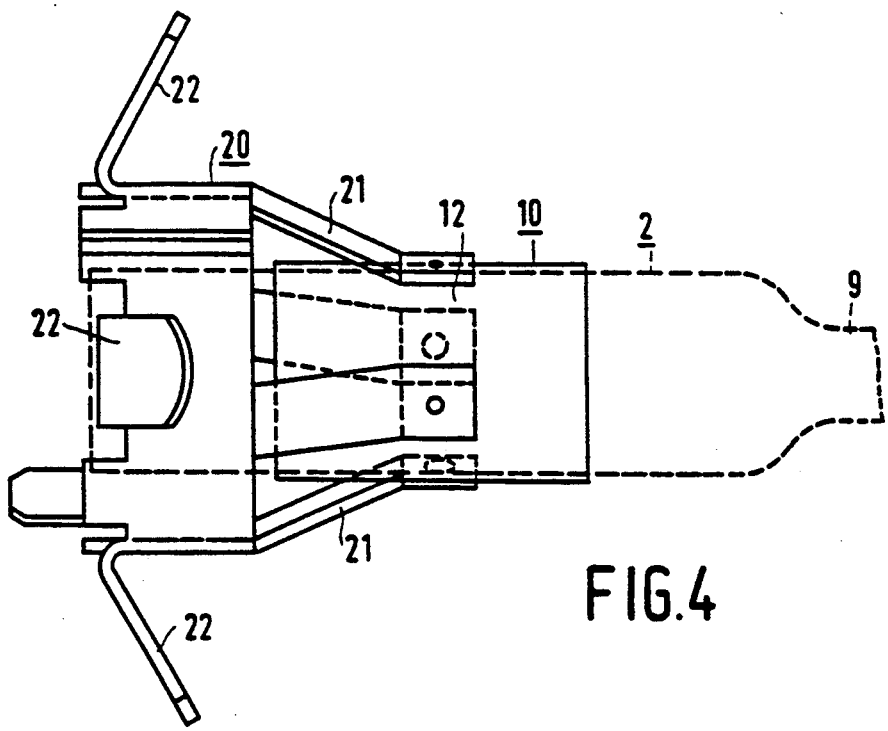
FIG. 4 shows the fixation member of the lamps of FIGS. 1 and 2 in side elevation.

The lamp has a lamp cap 30 (30′ in FIG. 2) of insulating material which is connected to the lamp vessel 1, and in which the fixation member 20 is fixed, in FIG. 4 by means of scraping tags 22 present on the member. Contact members 35, 36 (35′, 36′) are present connected to the current supply conductor 4 and, through a connection conductor 7, to the current supply conductor 5. The contact member 36 is a cylindrical ring at the outside of a collar 39 which surrounds the central, pin-shaped contact member 35. The cap can make contact with a bayonet connector which mechanically cooperates with a projection 38.

The lamp cap 30 (30′) has a screen cap 31 (31′). The lamp cap 30′ of FIG. 2 has a cover 37 from which cables issue to the exterior, carrying the contacts. In FIG. 1, the lamp vessel 1 has an outer envelope 40 which is kept centered around the conductor 3 by means of a narrowed portion 41. In FIG. 2, the connection conductor 7 is surrounded by an insulator 8.

The welding zone 12 of the sleeve 10 has mutually opposing closing tags 17 (see FIG. 5) alongside the slot 11.

Figure 3:
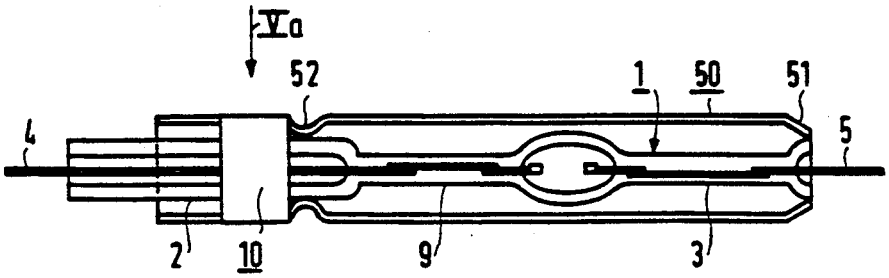
FIG. 3 shows a sub-assembly of metal sleeve and lamp vessel of a variation of FIG. 1 having a differently shaped outer envelope.

In FIG. 3, the lamp vessel 1 has an outer envelope 50 which at the area of narrowed portions 51, 52 therein is securely coupled to the lamp vessel. The diagrammatically indicated sleeve 10 around the first neck-shaped portion 2 is securely coupled to the outer envelope, and thus to the lamp vessel. The seal in the neck-shaped portion has reference numeral 9.

In FIG. 4, the fixation member 20 is fixed with its tongues 21 in the welding zone 12 of the diagrammatically indicated sleeve 10 by means of welding. The sleeve is present with direct clamping action on the neck-shaped portion 2 comprising the seal 9 of a lamp vessel.

Figure 5B:
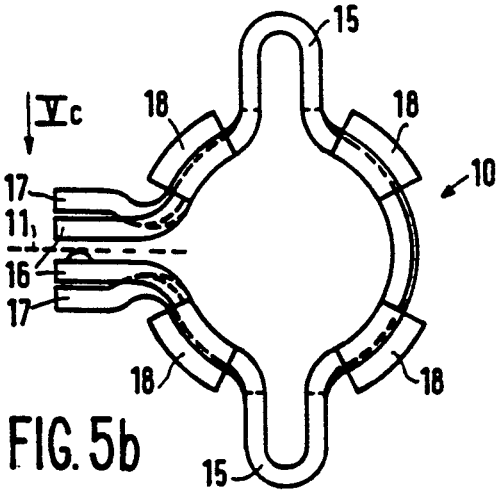
FIGS. 5*a, b, c* show the sleeve of the lamp of the preceeding Figures, where
Figure 5A:
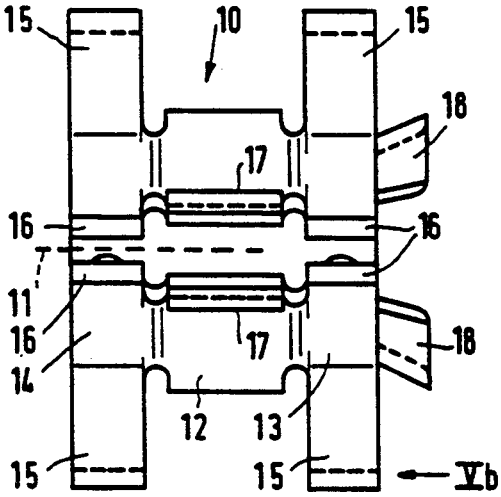
Figure 5C:
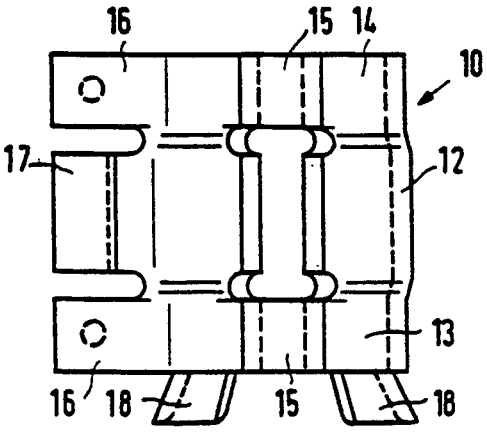

In the embodiment of the sleeve 10 shown in FIG. 5, the closing tags 17 are at a distance from one another, and even when mutually opposing welding lugs 16 have been brought into contact with one another, the closing tags were pulled toward one another by tools. This is evident from the greater interspacing between the closing tags 17 as compared with the welding lugs 16 (see FIGS. 5*a* and *b*).

The welding zone 12 for making welded joints with the fixation member 20 (FIG. 4) in the mounted sleeve 10 clears the clamped-in glass 2 (FIG. 4), which is evident from the fact that the internal diameter of the sleeve is greater in the welding zone than in the first 13 and second 14 clamping zone adjoining it on either side.

Each clamping zone 13, 14 has an open hairpin loop 15 (FIGS. 5*a*, 5*b*). The loops 15 are symmetrically arranged relative to the slot 11 (FIGS. 5*a, b*). They enclose an angle of $90° \pm 10°$ with the welding lugs 16.

The sleeve 10 shown has guiding tags 18 which are directed toward the electric elements 6 and whose interspacing increases in a direction away from the sleeve, so that they give the sleeve a funnel shape, whereby the sleeve can be readily provided around the glass 2 even if it has a smaller internal diameter than the glass in the non-assembled state.

We claim:

1. A capped electric lamp comprising (a) a lamp vessel including an internal electrical element, said lamp vessel having first and second neck-shaped portions with seals, and respective current supply conductors extending through said seals to said internal electrical element, (b) a metal sleeve holding said lamp vessel at first and second clamping zones at one of said first and second neck-shaped portions, said metal sleeve having a longitudinal slot, and said metal sleeve having a welding zone separate from said first and second clamping zones, each of said first and second clamping zones having at least a first loop in a shape of an open hairpin, said first and second clamping zones having respective mutually opposing welding lugs said welding lugs being interconnected by welded joints to close said metal sleeve, (c) a metal fixing member having tongues welded to said metal sleeve at said welding zone, (d) a lamp cap of insulating material connected to said lamp vessel, said metal fixing member being fixed in said lamp cap, said lamp cap having contact members, said contact members being connected to said current supply conductors, and (e) mutually opposing closing tags disposed at either side of said longitudinal slot and positioned between said clamping zones.

2. A capped electric lamp according to claim 1, wherein said closing tags are disposed at a distance apart.

3. A capped electric lamp according to claim 1, wherein said welding zone are disposed away from said one of said first and second neck-shaped portions.

4. A capped electric lamp according to claim 3, wherein each of said first and second clamping zones have a second loop in a shape of an open hairpin, said second loop of each of said first and second clamping zones being separated from said first loop of each of said first and second clamping zones around said metal sleeve.

5. A capped electric lamp according to claim 4, wherein said first and second loop of each of said first and second clamping zones are disposed symmetrically with respect to said longitudinal slot.

6. A capped electric lamp according to claim 5, wherein said first and second loops enclose an angle of $90° \pm 10°$ with said welding lugs.

7. A capped electric lamp according to claim 4, wherein said metal sleeve has guiding tags, said guiding tags being directed toward said internal electrical element, and said guiding tags having an interspacing increasing in a direction away from said metal sleeve.

8. A capped electric lamp according to claim 3, wherein said metal sleeve has guiding tags, said guiding tags being directed toward said internal electrical element, and said guiding tags having an interspacing increasing in a direction away from said metal sleeve.

9. A capped electric lamp according to claim 1, wherein each of said first and second clamping zones have a second loop in a shape of an open hairpin, said second loop of each of said first and second clamping zones being separated from said first loop of each of said first and second clamping zones around said metal sleeve.

10. A capped electric lamp according to claim 1, wherein said metal sleeve has guiding tags, said guiding tags being directed toward said internal electrical element, and said guiding tags having an interspacing increasing in a direction away from said metal sleeve.

* * * * *